United States Patent [19]

Holota

[11] Patent Number: 4,458,825

[45] Date of Patent: Jul. 10, 1984

[54] PLASTIC CONTAINER AND CLOSURE ASSEMBLY

[76] Inventor: Julien Holota, 321 Mullen Dr., Thornhill, Ontario, Canada

[21] Appl. No.: 379,432

[22] Filed: May 18, 1982

[30] Foreign Application Priority Data

Apr. 22, 1982 [CA] Canada ..... 401432

[51] Int. Cl.[3] ..... B65D 39/00

[52] U.S. Cl. ..... 220/307

[58] Field of Search ..... 220/306, 307, 354; 150/0.5

[56] References Cited

U.S. PATENT DOCUMENTS 4,334,631 6/1982 Ballester ..... 220/306

4,356,930 11/1982 Roper ..... 220/306

*Primary Examiner*—George T. Hall

*Attorney, Agent, or Firm*—Gipple & Hale

[57] ABSTRACT

A container made of plastic material and useful for holding paint or other substances has a cylindrical wall formed, around its upper end, with an inwardly projecting flange molded in one piece with the wall. Releasably interengageable formations on the flange and a peripheral portion of a lid secure the lid. A container bottom is formed separately from the wall and is bonded to the lower end of the wall to facilitate molding of the wall and the flange. The interengageable formations comprise annular projections on the lid and the flange and wedge formations on the lid and the flange urge the annular projection on the lid radially outwardly into engagement with that on the flange, the annular projections providing a primary lock between the lid and the flange which must be pried open before a secondary lock can be released.

26 Claims, 7 Drawing Figures

PLASTIC CONTAINER AND CLOSURE ASSEMBLY

FIELD OF THE INVENTION

The present invention relates to containers made of plastic material and is useful in particular, but not exclusively, for paint pails.

DESCRIPTION OF THE PRIOR ART

Conventional paint pails are made of metal and comprise a cylindrical wall formed, at its upper and lower ends, with peripheral rims of equal diameters, and provided with a metal lid. During the manufacture of such pails, the pails are rolled on the rims during labelling of the pails.

Such conventional metal pails have various disadvantages. For example, they tend to become dented during transportation and handling of the pails and this leads to wastage since the public prefers not to buy dented pails.

The metal pails can also rust, for example if exposed to water based paints or other moisture, and produce noise during their transportation and handling.

Consequently, attempts have recently been made to produce paint pails made of plastic material in order to provide corrosion resistance and low dentability and also a weight saving of, for example, 30% to 40% and the introduction of plastic paint pails has been encouraged by favourable consumer preference surveys.

As described in Modern Plastics, December 1981, Pages 52 and 53, various types of plastic paint pails have been proposed.

One such proposal is a pail in which grooved teeth are molded into the lid rim and the pail neck to provide secure retention of the lid relative to the pail and thus to satisfy drop test requirements. However, such teeth have the disadvantage that they tend to become clogged by dried paint and this makes it difficult, if not impossible, to replace the lid when the contents of the pail have been only partially consumed.

The above reference also refers to the manufacture of paint pails by an injection-blow molding process employing a rotary platen, employing three-part molds and also illustrates other interengageable pail neck and lid rim formations.

It has also been proposed to produce plastic containers with a metal rim and a metal lid engageable with rim, but such containers present difficulty in attaching the rim to the plastic wall of the container if the latter is not accurately dimensioned and shaped.

Furthermore, bearing in mind that the lids of paint pails are normally removed by insertion of the tip of the screwdriver or other tool beneath the rim of the lid in order to pry the lid from the container, and that therefore the side of the container is subjected to considerable stress, the connection of the metal rim to a plastic container wall presents a weakness.

BRIEF SUMMARY OF THE INVENTION

The present invention arises from the realization that it is desirable to simplify the molding of a paint pail or like plastic container and that this can be achieved by molding the wall of the container in one piece with a flange extending inwardly around the top end of the wall and shaped for interengagement with a lid, and also by forming the bottom of the container separately from the wall of the container and subsequently bonding the bottom to the wall. In this way, the flange can be formed as an integral part of the container wall, in order to provide greater rigidity and durability at the part of the container which is frequently under stress, caused by prying open of the container, closing of the container and installation of a handle on the container. No valve gating is necessary, and the molding of the integral flange and container wall is simplified and requires no collapsible cores, split cavities or forcing of material through a solid cavity and relying on memory of the material to come back to a desired shape or size.

Since the container wall is molded with an open bottom, cores and cavities can move with the moving platen of the injection molding machine employed for producing the wall, the wall being left on the stationary platen of the molding machine to facilitate removal from the machine.

The present invention further seeks to improve the interengagement of the lid with the wall flange by shaping the flange and the lid so that they force each other into mutually positive locking interengagement.

This can be achieved by providing the flange and the lid with formations which are interengageable and which comprise interengageable projections and wedge means for urging one of the projections outwardly into engagement with the other.

Thus, according to one aspect of the present invention, there is provided a container made of plastic material and comprising a wall of closed cross-section, an inwardly projecting flange extending around an upper part of the wall and molded in one piece with the wall, a lid, releasably interengageable formations on the flange and on a peripheral portion of the lid for securing the lid to the upper end of the wall to form a top closure for the container, and a container bottom formed separately from the wall and bonded to a lower end of the wall to form a bottom closure for the container.

According to another aspect of the present invention, there is provided a container comprising a cylindrical wall, an annular flange extending inwardly from the top of the cylindrical wall, a lid engaged with a flange and forming a top closure of the container, and a bottom wall closing the bottom of the container, the flange and the lid comprising formations which are interengageable for releasably and sealingly securing the lid to the flange, and the formations comprising first and second resiliently interengageable annular projections on the lid and the flange, respectively, and co-operating wedge means on the lid and the flange for urging the first annular projection radially outwardly into engagement with the second annular projection.

DESCRIPTION OF THE PREFERRED EMBODIMENT

Further features, objects and advantages of the invention will be more readily understood from the following description of a preferred embodiment thereof given, by way of example, with reference to the accompanying drawings, in which.

Figure 1:
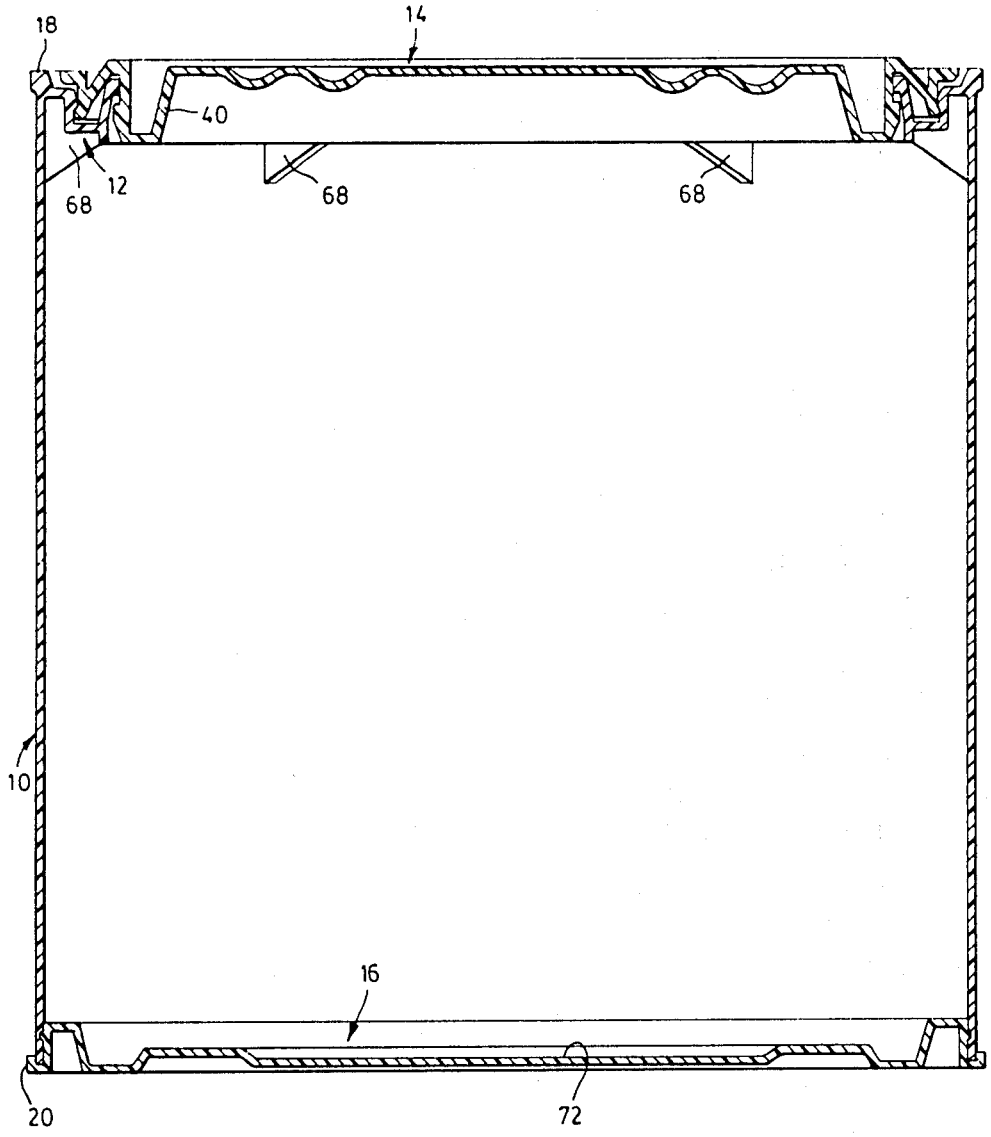
FIG. 1 shows a view taken in vertical section through a paint pail embodying the present invention.
Figure 2:
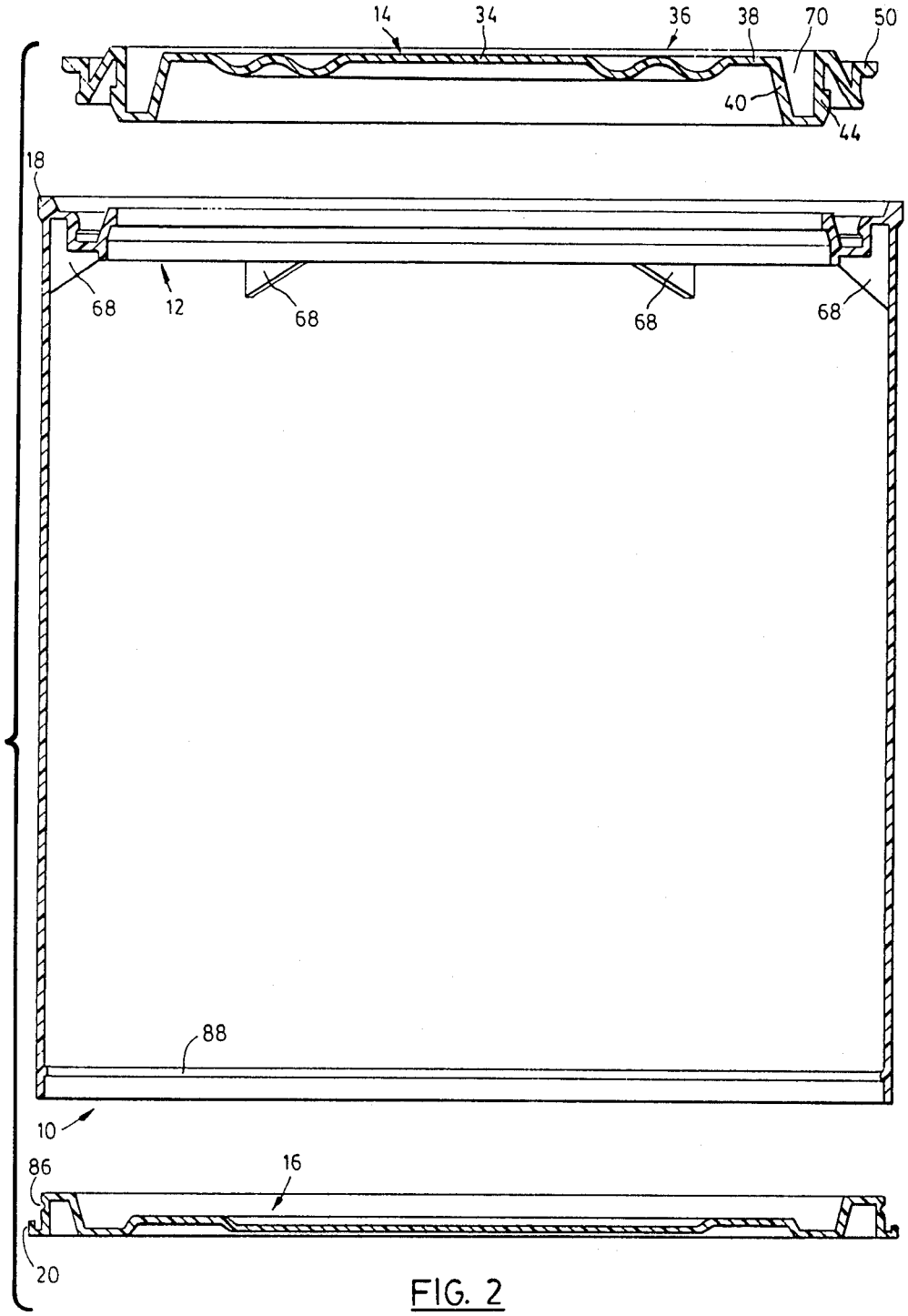
FIG. 2 shows an exploded view corresponding to that of FIG. 1 with the lid and the bottom of the pail separated from the cylindrical wall of the pail.

The paint pail shown in the drawings has a cylindrical wall indicated generally by reference numeral 10, which is molded in one piece with a lid securement flange indicated generally by reference numeral 12, which extends inwardly of the cylindrical wall 10 around the upper end of the latter.

A lid 14 is releasably engageable with the flange 12 to form a top closure for the paint pail, and a bottom 16, which is formed separately from the wall 10, is bonded to the lower end of the cylindrical wall 10 to form a bottom wall or closure for the pail.

An annular upper rim 18 projects laterally outwardly of the cylindrical wall 10 at the upper end of the wall 10 and is molded in one piece with the wall 10, and a lower annular peripheral rim 20 projects laterally of the wall 10 at the lower end of the wall 10 and is molded in one piece with the bottom 16, the rim 20 having the same outer diameter as the rim 18.

Figure 3:
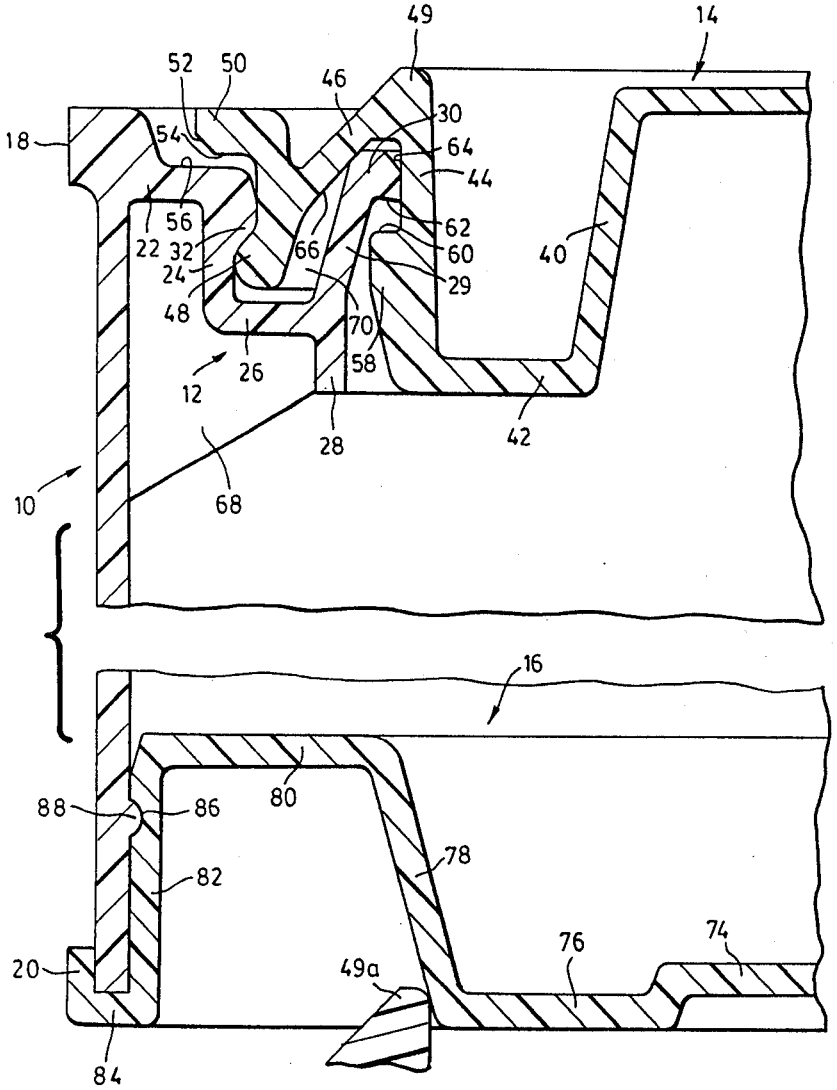
FIG. 3 shows a broken-away view, in vertical cross-section, of the upper and lower ends of the container of FIG. 1 on an enlarged scale to illustrate features of the container in greater detail.

As shown in FIG. 3, the flange 12 comprises a flat annular horizontal outer portion 22, integral with the wall 10 and with an outer cylindrical portion 24, an inner flat annular horizontal portion 26 extending from the lower end of the outer cylindrical portion 24, an inner cylindrical portion 28 depending from the inner side of the horizontal portion 26, and an upwardly and inwardly inclined flange portion 29 extending from the top of the inner cylindrical portion 28 and formed with an annular projection 30.

The inner cylindrical portion 28 is formed with a thickened portion 32 forming a radially inwardly extending annular projection 32 which extends from the top of the outer cylindrical portion 24 over approximately one-half of the height of the latter.

The lid 14 has a flat circular central portion 34 surrounded by a pair of annular corrugations 36 and a flat annular portion 38 between the corrugations 36 and a depending frusto-conical wall 40.

A flat annular portion 42 extends from the frusto-conical portion 40 to an upstanding cylindrical wall 44.

A downwardly and outwardly inclined frusto-conical web 46 extends from top of the cylindrical wall 44 to an edge portion of the lid 14, the edge portion comprising a lowermost, laterally outwardly extending annular projection 48 and an uppermost laterally outwardly extending annular rim 50. The rim 50 has an outer edge which is formed with a bevel 52 extending to a flat annular undersurface 54 of the rim 50, the undersurface 54 being spaced by a gap from the uppermost surface 56 of the horizontal outer portion 22 of the flange 12.

The cylindrical wall 44 of the lid 14 is formed at its exterior with a thickened portion 58 forming an annular shoulder 60, which is spaced downwardly from an opposed downwardly-facing annular shoulder 62 at the underside of the annular projection 30.

Above the shoulder 60, the cylindrical wall 44 has a cylindrical outer surface 64, and the annular projection 30 has a cylindrical inner surface 66 in surface-to-surface contact with the cylindrical surface 64.

The web 46 has an upwardly and outwardly inclined undersurface 66, the surfaces 64 and 66 being upwardly convergent and defining a downwardly open annular recess receiving the annular projection 30.

The surfaces 64 and 66 act as wedge surfaces in cooperation with the annular projection 30, which acts as a wedge member, the web 46 being resiliently outwardly deflectable by the wedging action of the annular projection 30 between the surfaces 64 and 66 for urging the annular projection 48 outwardly into engagement with the annular projection 32. The interengagement of the annular projections 32 and 48 forms a primary lock for securing the lid 14 to the flange 12, the projections 32 and 48 acting as locking projections which are interengageable by a snap action when the lid 14 is pressed downwardly into engagement with the flange 12.

The shoulders 60 and 62, which are vertically spaced apart from one another as illustrated in FIG. 3 when the lid 14 is engaged with the flange 12, act as a secondary lock between the lid 14 and the flange 12. More particularly, when the lid 14 is to be removed from the container, a screwdriver tip or the like is inserted the gap between the undersurface 54 of the rim 50 and the upper surface 56 of the flange portion 22 at one of a pair of notches 63 (FIG. 4) formed diametrically oppositely in the rim 50. The screwdriver is then employed to raise the rim 50 by a prying action, and thus to disengage the projection 48 from the projection 32, the web 46 being resiliently deflectable for this purpose. As the lid 14 is thus raised relative to the flange 12, the upwardly facing shoulder 60 on the lid 14 is moved into engagement with the downwardly facing shoulder 62 on the flange portion 29 to prevent the lid 14 from springing upwardly. The shoulder 60 can be moved upwardly past the shoulder 62 to release the lid 14 from the flange 12 by further prying, the flange portion 29 being resiliently outwardly deflected by the shoulder 60.

Thus, the lid is releasably but securely retained relative to the flange 12 by two locks, one formed by the projections 32 and 48 and the other formed by the shoulders 60 and 62.

The flange 12 is rigidified, and thus strengthened against distortion during the above-described prying operation, by means of six radial fillets or flanges 68 which are molded in one piece with the inner surface of the cylindrical wall 10, the undersides of the flange portions 22 and 26 and the outer cylindrical surfaces of the cylindrical flange portions 24 and 28. A larger member of the flanges 68 may be employed if necessary to provide additional strength and the flanges 68 may be extended downwardly as far as the bottom 16 if necessary to reinforce the cylindrical wall 10 against buckling.

The flange portions 24, 26 and 29 define an upwardly-open annular channel 70 which receives the annular projection 48 and it also serves as a drip collector for collecting drips of paint when the pail is in use.

Figure 4:
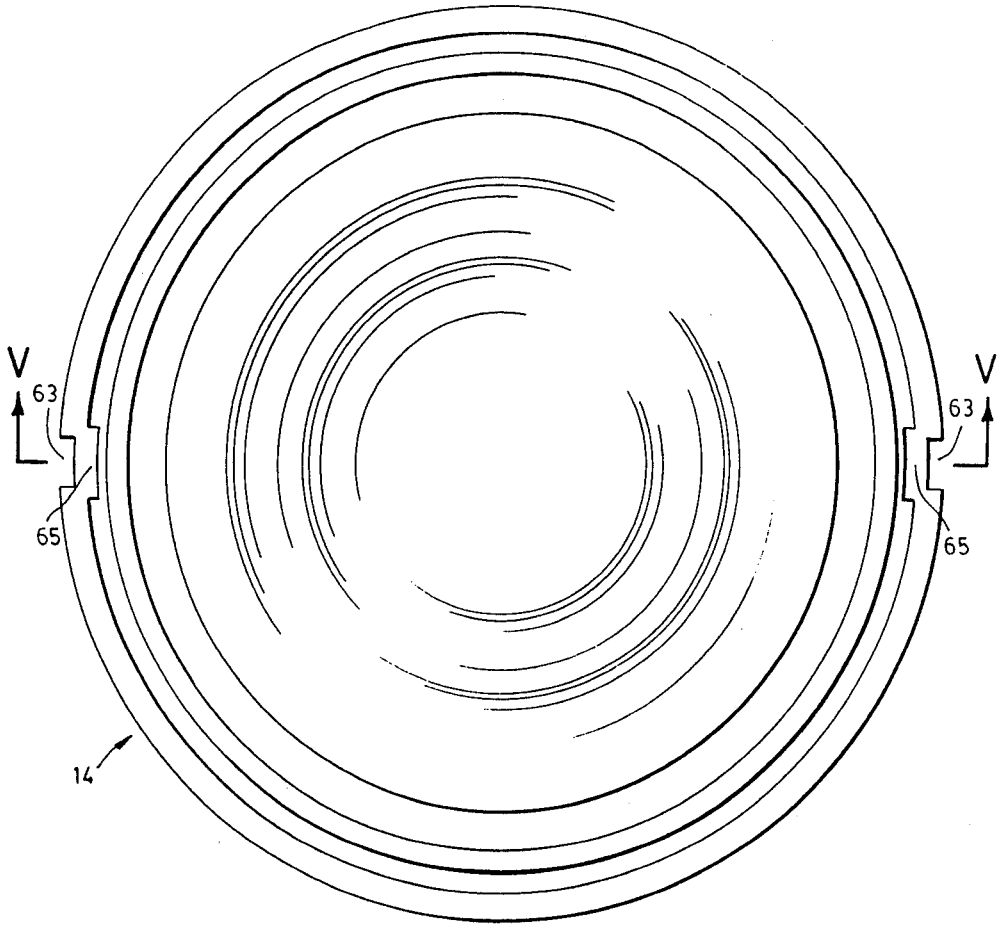
FIG. 4 shows a plan view of the lid of the pail of FIG. 1.
Figure 5:
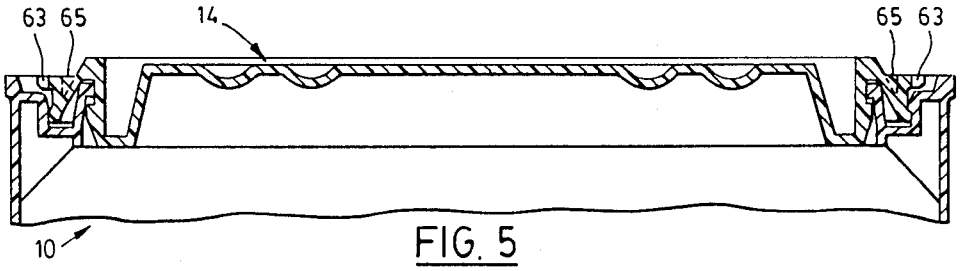
FIG. 5 shows a view in vertical cross-section through the lid taken along line V—V of FIG. 4.

The lid 14 is reinforced against the above-described prying action at the notches 63 by solid reinforcement 65 which extend between and are integral with the rim 50 and the upwardly inclined web 46, as shown in FIGS. 4 and 5.

When the lid 14 is in the closed position in which it is shown in FIG. 3, the interior of the pail is sealed relative to the exterior at the annular lines of seal by the contact of the annular projection 30 with the underside 66 of the web 46 and the surface 64 and by the contact between the peripheral portion of the lid 14 and the flange 12 at the annular projections 32 and 48.

The bottom 16 has a flat-bottomed central circular recess 72 surrounded by a flat annular portion 74, which in turn is surrounded by a flat-bottomed annular recess 76. The recess 76 has an outer frusto-conical wall 78 extending upwardly to a flat annular web 80, from the outer edge of which a cylindrical wall 82 extends downwardly. An annular web 84 extends between the bottom of the cylindrical wall 82 and the lower rim 16.

The outer surface of the cylindrical wall 82 engages with an interference fit in the inner surface of the cylindrical wall 10.

The outer surface of the cylindrical 82 is also formed with an annular recess bead 86 in which engages in a complimentary annular bead 88 on the inner surface of the cylindrical wall 10.

The bottom 16 is permanently secured to the container wall 10 by an ultrasonic bond between the cylindrical walls 82 and 10 at the bead 88.

Figure 6:
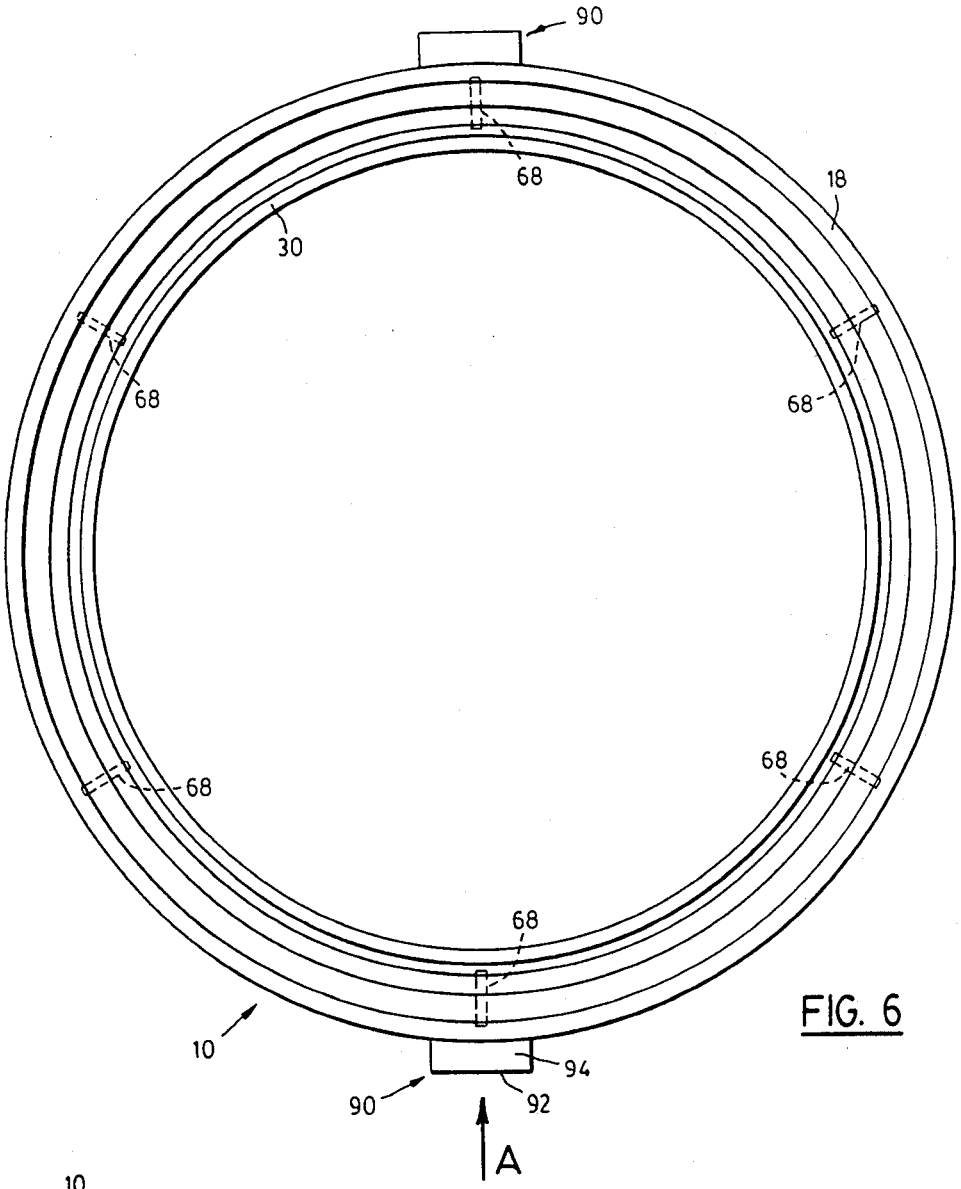
FIG. 6 shows a plan view of the pail of FIG. 1 with the lid removed.
Figure 7:
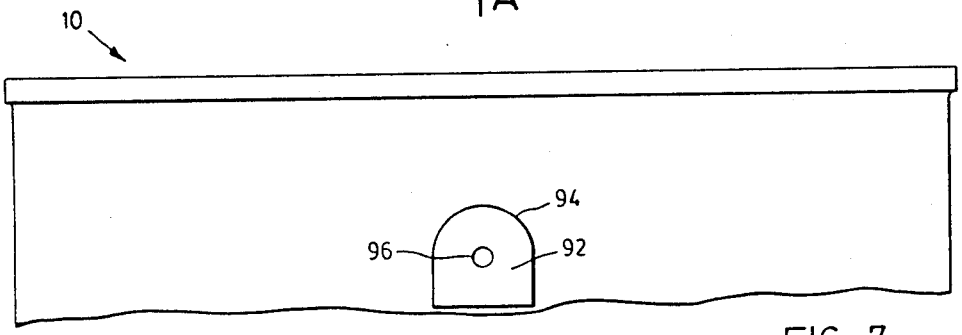
FIG. 7 shows a broken-away side view in the direction of arrow A of FIG. 6.

A pair of ears indicated generally by reference numerals 90 (FIG. 6) are provided for attachment of a handle (not shown) to the pail. Each ear 90 has an outer wall 92 spaced from the cylindrical wall and a connecting wall 94 extending along both sides of the wall 92 and around the top of the wall 92, which is semicircular, the wall 94 being integral with the walls 92 and 10 and the ears 90 being downwardly open to facilitate molding of the pail. Each wall 94 is formed with a circular opening 96 for engagement by one end of the handle.

As shown in FIG. 3, the inclined web 46 and the cylindrical wall 44 meet and merge at an annular projection 49 which projects upwardly beyond the top of the upper rim 18. The internal diameter of the annular projection 49 corresponds to the external diameter of the lower portion of the frusto-conical wall 78 to allow stacking of the pail with a similar pail as illustrated in FIG. 3, in which the wall 78 is shown in stacked relation with a broken-away protion of the corresponding annular projection, indicated by reference numeral 49*a*, of an underlying pail identical to the above-described pail.

As will be apparent from the above description, the present pail provides a good sealing and a secure interconnection of the lid 14 to the flange 12, and thus to the cylindrical wall 10, by means of the above-described three seals and two locks. Thus, the lid 14 is well secured against inadvertent dislodgement of the lid, for example when the pail is dropped.

The entire pail is formed by injection molding, for example, polypropylene, which facilitates the ultrasonic bonding of the bottom 16. Since the flange 12 and fillets 68 are integral with the cylindrical wall 10, the top of the pail is sufficiently rigid and durable to withstand the stresses exerted thereon during closing of the lid, removal of the lid and of handling of the pail.

Since the bottom 16 is molded separately, the one-piece molding of the wall 10, the flange 12 and the fillets 68 does not require the use of collapsible cores or split cavities and is therefore substantially simplified. Cores and cavities of the molding machine are displaced with the moving platen, to leave the container on the stationary platen of the machine, from which it can be automatically removed and transferred to a conveyor for assembly of the bottom 16 and subsequent operations.

The shapes of the interengaged portions of the cylindrical wall 10 and the bottom 16 facilitate ultrasonic welding together of these two parts since an ultrasonic welding head (not shown) can be received within the outwardly concave annular recess defined by the walls 78 and 82. Alternatively, the bottom 16 can be secured to the wall 10 by a suitable bonding adhesive.

A further advantage of the above-described pail is that it is similar, in external shape, to conventional metal paint pails. This has not only the advantage of facilitating acceptance of the present pail by the buying public, but also of facilitating handling of the present pail by conventional metal pail machinery. Thus, a conventional metal paint pail is formed, at its upper and lower ends, with peripheral rims of equal diameters, on which the pail is rolled during labelling of the pail. The rims 16 and 18 of the present pail, which as indicated above are also equal diameters, enable labelling of the present pail to be effected in the same manner. Also, the present pail can be filled and have its lid added by machinery presently used for these functions with metal pails.

The above-described pail is particularly suitable for manufacture in a fully automated process.

The embodiments of the invention in which an exclusive property or privilege is claimed are defined as follows:

1. A container made of plastic material and comprising:

an inwardly projecting flange extending around an upper end of said wall and molded in one piece with said wall;

a lid;

releasably interengageable formations on said flange and on a peripheral portion of said lid for securing said lid to the upper end of said wall to form a top closure for said container; and a container bottom formed separately from said wall and bonded to a lower end of said wall to form a bottom closure for said container.

2. A container as claimed in claim 1, wherein said formations comprise two annular first locking formations on said flange and two annular second locking formations on said lid peripheral portion, said first and second locking formations being interengageable with one another for securing said lid to said flange.

3. A container as claimed in claim 2, wherein said formations include wedge means for urging said first formations into interengagement.

4. A container as claimed in claim 1, wherein said formations comprise first and second locking formations formed on said flange and respectively interengageable with first and second formations on said lid peripheral portion, said flange and said lid further including wedge means for urging said first locking means into interengagement and said first locking means forming an annular seal between said lid and said flange and said wedge means forming two further annular seals between said flanges and said lid.

5. A container as claimed in claim 2, wherein said second formations comprise a pair of opposed shoulders, said shoulders being spaced apart on interengagement of said first and second formations and being adapted to abut one another upon disengagement of said first formations.

6. A container as claimed in claim 1, wherein said lid peripheral portion has a peripheral edge spaced from said flange, on interengagement of said formations, and formed with notches to facilitate prying of said lid from said flange.

7. A container as claimed in claim 1, wherein said wall upper end and said container bottom are each formed with an integral rim projecting from the periphery of said wall.

8. A container as claimed in claim 1, wherein said container bottom comprises a wall of closed cross-section fitting snugly within said container wall, said bottom wall and said container wall having interengaged annular peripheral recess and projection formations.

9. A container as claimed in claim 1, wherein said lid and said bottom comprises means for stacked engagement with a corresponding bottom and lid, respectively, of like containers.

10. A container as claimed in claim 1, further comprising wedge means for urging said formations with interengagement.

11. A container as claimed in claim 10, wherein said wedge means comprise a wedge member in sealing contact with two wedge surfaces to form two annular seals between said flange and said lid.

12. A container as claimed in claim 1, wherein said formations form an annular seal between said flange and said lid.

13. A container made of plastic material and comprising:

a cylindrical wall;

upper and lower annular rims of equal diameters encircling upper and lower ends, respectively, of said wall;

an annular flange molded in one piece with said wall upper end and projecting inwardly of said wall;

a circular lid;

formations on said flange and on a peripheral portion of said lid for releasably securing said lid to said wall; and a circular container bottom closure bonded to said wall lower end and forming a closure for the bottom of said container.

14. A container as claimed in claim 13, wherein said formations comprise first interengageable formations on said lid and said flange, respectively, and wedge formations spaced inwardly from said first formations for urging the latter into engagement with one another.

15. A container as claimed in claim 14, wherein said formations include opposed projections on said lid and said flange for retaining said lid relative to said flange, said opposed projections being spaced apart from one another on interengagement of said first formations to facilitate disengagement of the latter.

16. A container as claimed in claim 15, wherein said lid is formed with a peripheral edge spaced from said flange, on interengagement of said formations, to facilitate prying of said lid from said flange.

17. A container as claimed in claim 13, wherein an upwardly open annular channel is formed in said flange.

18. A container as claimed in claim 13, wherein said annular rims are formed integrally with said wall and said bottom closure, respectively.

19. A container as claimed in claim 13, wherein said bottom closure has an at least substantially cylindrical wall snugly fitting into the bottom of said container wall, an annular projection on one of said walls engaging in an annular recess in the other of said walls.

20. A container, comprising:

a cylindrical wall;

an annular flange extending inwardly from the top of said cylindrical wall;

a lid engaged with said flange and forming a top closure of said container; and a bottom wall closing the bottom of said container;

said flange and said lid comprising formations which are interengageable for releasably and sealingly securing said lid to said flange; and said formations comprising first and second resiliently interengageable annular projections on said lid and said flange, respectively, and co-operating wedge means on said lid and said flange for urging said first annular projection radially outwardly into engagement with said second annular projection.

21. A container as claimed in claim 20, wherein said first annular projection is provided on a resiliently outwardly deflectable peripheral portion of said lid, said wedge means including a wedge surface on the underside of said peripheral portion.

22. A container as claimed in claim 21, wherein said wedge means include a wedge projection on said flange, said wedge projection extending into an annular recess in said lid and said annular recess being defined by said wedge surface and a further wedge surface on said lid, said wedge surfaces being upwardly convergent.

23. A container as claimed in claim 22, wherein said wedge projection is provided on an upstanding resiliently deflectable portion of said flange, said flange portion forming one wall of an upwardly-open annular recess formed in said flange and said second annular projection being located in said annular recess.

24. A container as claimed in claim 22, wherein opposed shoulders are formed on said wedge projection and said lid, said shoulders being spaced apart on interengagement of said first and second annular projections and being adapted to abut one another to oppose removal of said lid from said flange upon disengagement of said first and second annular projections.

25. A container as claimed in claim 20, wherein said lid has an annular edge spaced upwardly from said flange to facilitate prying of said lid from said flange.

26. A container as claimed in claim 20, further comprising means integral with the inner surface of said cylindrical wall and the underside of said flange for reinforcing said flange.

* * * * *